United States Patent [19]

Pollak

[11] 4,363,344

[45] * Dec. 14, 1982

[54] HAMMER

[76] Inventor: I. Scott Pollak, 14 Greenway Rd., Armonk, N.Y. 10504

[ * ] Notice: The portion of the term of this patent subsequent to May 15, 1996, has been disclaimed.

[21] Appl. No.: 37,344

[22] Filed: May 9, 1979

Related U.S. Application Data

[63] Continuation-in-part of Ser. No. 869,060, Jan. 13, 1978, Pat. No. 4,154,273.

[51] Int. Cl.[3] ..... B25C 1/00

[52] U.S. Cl. ..... 145/29 R; 145/36; 145/61 R; 145/61 L

[58] Field of Search ..... 145/29 R, 29 A, 29 B, 145/29 C, 29 D, 36, 2 R, 2 A, 61 R, 61 L

[56] References Cited

U.S. PATENT DOCUMENTS

| | | | |
|---|---|---|---|
| D. 56,553 | 11/1920 | Clay | 145/29 D |
| 131,754 | 10/1872 | Hart | 145/2 R |
| 4,038,719 | 8/1977 | Bennett | 145/61 L |
| 4,154,273 | 5/1979 | Pollak | 145/29 R |

FOREIGN PATENT DOCUMENTS

| | | | |
|---|---|---|---|
| 21725 | 12/1916 | Denmark | 145/29 R |

*Primary Examiner*—James M. Meister
*Assistant Examiner*—J. T. Zatarga
*Attorney, Agent, or Firm*—Dayton R. Stemple

[57] ABSTRACT

A hammer having a rigid handle composed of proximal and distal portions angularly disposed to each other, neither of which are disposed parallel or at right angle relative to the striking face of the hammer head.

12 Claims, 6 Drawing Figures

HAMMER

This is a continuation-in-part application of my copending application, Ser. No. 869,060, filed Jan. 13, 1978, now U.S. Pat. No. 4,154,273, granted May 15, 1979.

This invention relates to new and useful improvements in hammers and more particularly seeks to provide a hammer handle having a proximal and distal portions, neither portion of which is parallel to the planar working surface of the hammer head.

The customary hammer is composed of a straight handle disposed at right angles to the hammer head and parallel to the palnar working surface, and attached to a central portion of the hammer head between the planar working surface (striking portion) and the other end. In its usage, the holder, e.g. a carpenter employs his shoulder, full arm and wrist; all working together to strike the nail a blow with the hammer head. At the moment that a blow is struck to drive a nail fully into the work, the carpenter's hand gripping the hammer handle, due to the configuration of the hammer, does not take full advantage of the potential wrist movement.

It is the primary object of the present invention to provide a hammer which is so designed that the required working blows is accomplished without shoulder and full arm usage, but mainly by the worker's forearm muscle and wrist movement. This enables a greater control of the working movement of the hammer head and greater accuracy in its striking action.

An optimal object of the invention is to provide a carpenter's hammer which is designed to minimize the possibility of the worker's knuckles coming into contact with the work during usage of the hammer.

Other objects and advantages, as well as the novel features of construction and manner of use of my improved hammer will become apparent from a perusal of the following description, when read in connection with the accompanying drawings, in which.

Figure 1:
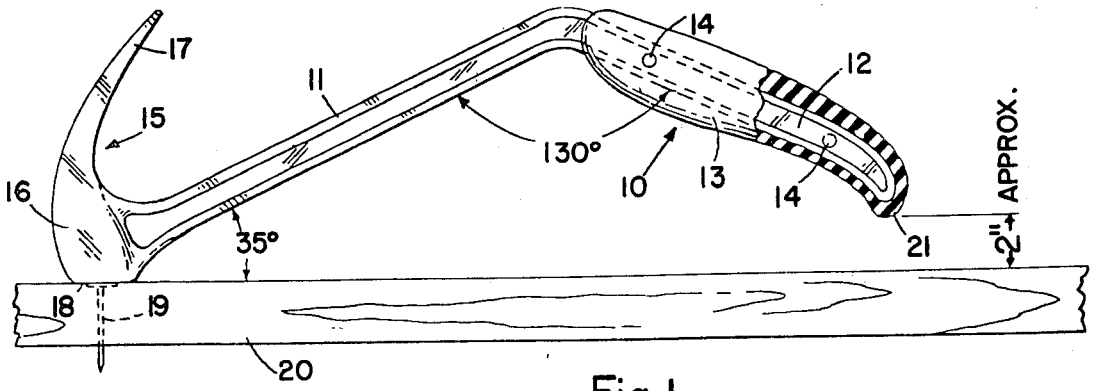
FIG. 1 is a side elevational view of a nailing hammer constructed in accordance with my invention.
Figure 2:
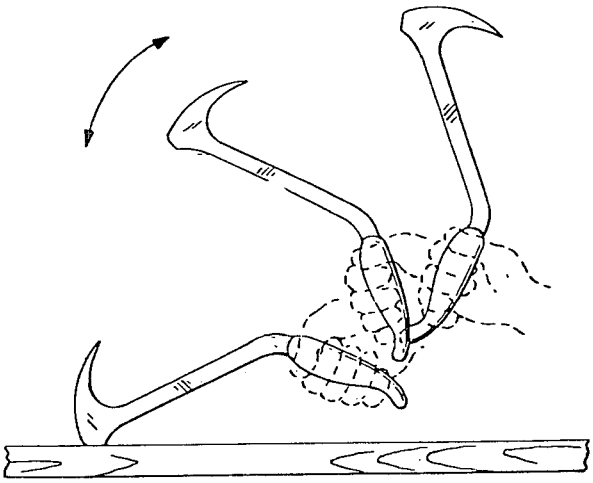
FIG. 2 is a diagrammatic view showing the movements of the hammer as it is moved to strike the blow shown in FIG. 1.
Figure 3:
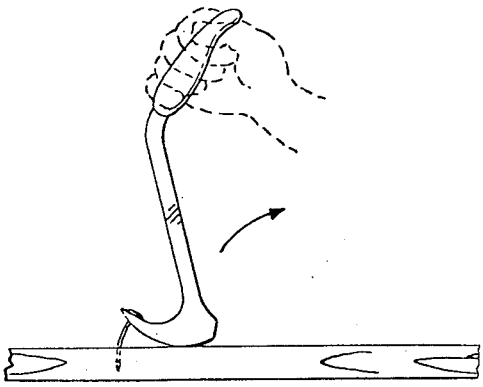
FIG. 3 is a side elevational view indicating the leverage applied when the hammer is employed to remove a nail from a workpiece.

In the drawings, the handle is shown to be composed of two angularly disposed portions. As shown in FIGS. 1-3, a distal handle portion 10 is composed of an elongaged member 12 which at its inner end is united to the outer end of a proximal handle portion 11. It is essential that the angular relation between handle portions 10 and 11 be such that the distal portion should never reach a parallel relationship with the work surface. Further, the connection between handle portion 11 and the member 12 may be curved instead of the sharp angularity illustrated. It is also contemplated that the handle portion 11 and member 12 be themselves curved so that the handle as a whole becomes curved. Mounted on member 12 is a grip 13 configured to enable the worker to obtain a firm grasp of the hammer and which may be made of any suitable material such as polyethelene or simply a continutation of the total handle material. The grip 13 may be secured to member 12 in any suitable fashion as by the studs 14 which may be integral with or secured to the member 12 in a manner known to the art.

Mounted on the inner end of proximal handle portion 11 is a head 15 having a solid body 16 from the upper end of which extends conventional claws 17. The striking surface 18 of the hammer head may have a planar area of any conventional shape with the planar surface being disposed at an acute angle to the proximal handle portion 11 work surface.

It is preferred that the hammer head 15, the handle portion 11 and the handle member 12 be formed of metal in one piece, although the handle portion 11 and member 12 may be made in one piece separate from the head 15 and joined to the head 15 in any suitable manner known to the art. The one piece handle portion 11 and member 12 may be made as a tubular extrusion or as a solid drop forged piece preferably of I-beam construction, as illustrated, in order that the handle may have maximum strength using a minimum of material.

Figure 4:
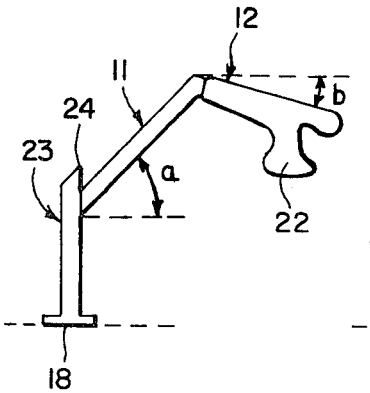
FIG. 4 is a side elevational view of a modified hammer head and handle angles.

The lengths of the handle portions may be varied for specific applications. Whatever relation of lengths of the two portions are selected for a particular use, the angular relations between such portions and between portion 11 and the striking face 18 are selected so that when the striking face 18 of the head rests on the surface of the work, the outer end of handle portion 10 will be spaced (2" in FIG. 1) from such work surface. In order that the possibility of the worker's hand coming into contact with the work during the usage of the hammer may be eliminated, the outer end of the distal handle portion 10 beyond the worker's hand portion is optionally turned downwardly to provide a protective blocking element 21, as shown in FIG. 1. Thus, if the outer end of the distal handle portion 10 should strike the working surface 20, the blocking element 21, would protect the worker's hand from coming into contact with such surface. As shown in FIG. 4, the protection afforded may be enhanced by forming a larger blocking element 22 and which may be located intermediate the ends of the distal handle portion. The blocking elements 21, 22 have a further advantage in that by reason of their hooked configuration, it lessens the likelihood of the hammer flying out of the worker's hand during usage.

FIG. 2 of the drawings illustrates the manner in which the various parts of the worker's arm and wrist cooperate to produce the required striking force by this hammer. It will be observed that as the hammer is raised and swung downwardly to make a strike, there is relatively little movement of the upper part of the arm and consequently of the shoulder of the worker. The principal movement of the worker's arm takes place below his elbow so that the downward swing of the hammer is accomplished mainly by the worker's forearm muscles which are so employed that there is a more natural movement of the wrist than occurs in the use of the usual carpenter's hammer. It has been found that as a result of this hammer construction, use thereof provides a high degree of control in the movements of the hammer and a higher accuracy in its working impact. Further, even though it takes less effort to work this hammer, when the hammer is swung downwardly the momentum of the head 15 will be greater than that obtained with the usual straight handled hammer, because of the angular relation of the hammer portions 10 and 11. As a result, the striking force of the head will be substantially greater than that of the usual straight handled hammer.

FIG. 3 of the drawings illustrates the increased pulling leverage that is effected by the hammer of this invention when it is employed in extracting nails from a workpiece.

Figure 5:
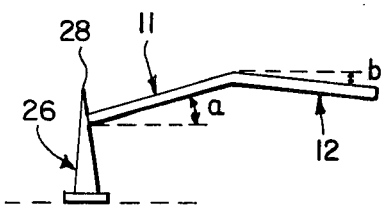
FIG. 5 is a side elevational view of another modified hammer head and handle angles.
Figure 6:
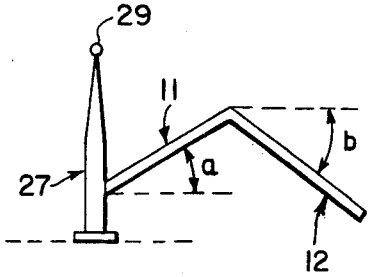
FIG. 6 is a side elevational view of a still another modified hammer head and handle angles.

FIG. 4 shows a head 23 having a planar working surface 18 and a sharp edge 24 at the other end. FIGS. 5 and 6 show heads 26 and 27 with a point 28 and ball-peen 29 respectively at the other ends. The invention is primarily concerned with the planar working surface 18 as it relates to the angles of the distal and proximal handle portions so that any conventional structures may be provided at the other head end. A typical carpenter's hammer and sheet metal body hammers have been shown but obviously any type of hammer head may be used with the handle shown herein.

The handle portion angles are better defined by measurement from planes parallel to the planar working surface 18, said planes passing through the respective intersection points of the proximal handle portion, forst with the head (called proximal angle) and second with the distal handle portion (called distal angle). The proximal angle is a and distal angle b in FIG. 4 to 6. The proximal angle is shown at 35° in FIG. 1 but the distal angle is not measured there.

The proximal angle a is workable from 10° to 80 °, preferred at 15° to 60° and most preferred at 20° to 50°. The distal angle b is workable from 5° to 80°, preferred at 10° to 60° and most preferred at 10° to 30°.

It will be evident from the foregoing description that changes in the form, proportion and construction of the parts of the hammer disclosed may be resorted to without departing from the spirit of the invention or the scope of the appended claims.

I claim:

1. A hammer comprising a head having on one end a planar striking face, a proximal handle portion rigidly secured at its inner end to said head and angularly disposed to said face, and a distal handle portion angularly and rigidly secured at its inner end to the outer end of said proximal handle portion, said handle portions and head having given lengths and being disposed in a first plane that is perpendicular to said planar striking face, said proximal handle portion describing a proximal angle from 10° to 80° above a second plane parallel to said planar striking face and passing through the intersection point of said head and the longitudinal axis of said proximal handle portion, said distal handle portion describing a distal angle from 5° to 80° below a third plane parallel to said planar striking face and passing through the intersection point of the longitudinal axes of said handle portions, all being such that the outer end of said distal handle portion is spaced from the plane of said planar striking face, said distal handle portion constituting a hand-grip member for hammer manipulation by a user.

2. The hammer of claim 1 wherein said proximal angle is 15° to 60°.

3. The hammer of claim 1 wherein said proximal angle is 20° to 50°.

4. The hammer of claims 1, 2 or 3 wherein said distal angle is 10° to 60°.

5. The hammer of claims 1, 2 or 3 wherein said distal angle is 10° to 30°.

6. The hammer of claims 1, 2 or 3 wherein said head has claws at the other end.

7. The hammer of claim 4 wherein said head has claws at the other end.

8. The hammer of claim 5 wherein said head has claws at the other end.

9. The hammer of claim 1, 2 or 3 wherein said distal handle portion carries a portion near the outer end hooked toward said proximal portion to provide protection to the hand of the user.

10. The hammer of claim 4 wherein said distal handle portion carries a portion near the outer end hooked toward said proximal portion to provide protection to the hand of the user.

11. The hammer of claim 5 wherein said distal handle portion carries a portion near the outer end hooked toward said proximal portion to provide protection to the hand of the user.

12. A hammer comprising a head having on one end a planar striking face, and a handle consisting of only two distinct portions, namely a proximal handle portion rigidly secured at its inner end to said head and angularly disposed upwardly to said face, and a distal handle portion angularly disposed downwardly, and rigidly secured at its inner end, to the outer end of said proximal handle portion, said handle portions and head having given lengths and being disposed in a first plane that is perpendicular to said planar striking face, said proximal handle portion describing a proximal angle from 10° to 80° below a third plane parallel to said planar striking face and passing through the intersection point of said handle portions to each other, all being such that the outer end of said distal handle portion is spaced above the plane of said planar striking face, each handle portion being substantially without curvature along its longitudinal axis, said distal handle portion constituting a hand-grip member for hammer manipulation by a user.

* * * * *